US005580319A

United States Patent [19]

Hamilton

[11] Patent Number: 5,580,319

[45] Date of Patent: Dec. 3, 1996

[54] MINIATURE GOLF COURSE MAZE

[76] Inventor: Charles P. Hamilton, 2018 Proude St., Port Charlotte, Fla. 33953

[21] Appl. No.: 554,345

[22] Filed: Nov. 6, 1995

Related U.S. Application Data

[63] Continuation-in-part of Ser. No. 4,092, Sep. 21, 1995.

[51] Int. Cl.[6] ..... A63B 69/36

[52] U.S. Cl. ..... 473/150; 473/158

[58] Field of Search ..... 273/176; 473/150–172

[56] References Cited

U.S. PATENT DOCUMENTS

| | | | |
|---|---|---|---|
| 610,336 | 9/1898 | White | 273/176 B |
| 1,576,140 | 3/1926 | Schneider | 273/176 E |
| 1,952,624 | 3/1934 | Inman et al. | 273/176 E |
| 2,750,192 | 6/1956 | Haslett | 273/176 E |
| 3,084,941 | 4/1963 | Anthony | 273/176 E |
| 3,831,949 | 8/1974 | Henning | 273/176 H |
| 3,862,760 | 1/1975 | Davis | 273/176 E |
| 4,429,881 | 2/1984 | Barrett | 273/176 B |

FOREIGN PATENT DOCUMENTS

| | | | |
|---|---|---|---|
| 704213 | 10/1930 | France | 273/176 E |
| 3009857 | 5/1993 | WIPO | 273/176 AB |

*Primary Examiner*—Mark S. Graham
*Attorney, Agent, or Firm*—Frank A. Lukasik

[57] ABSTRACT

A miniature golf putting course laid out in the form of a maze. The miniature golf course is placed inside of a maze and is then controlled by a series of gates. Changing the position of the gates changes the route one must follow to correctly negotiate the course. Each of the holes have a cover suitable for simulating the effect of a golf ball rolling on grass, each of the hazards are arranged to interfere with the path of a golf ball, and each of the holes have a tee end and a green end which may be changed by changing the position of the gates.

3 Claims, 8 Drawing Sheets

1
2
3
4
5
6
7
8
9
10
11
12
13
14
15
16
17
18

MINIATURE GOLF COURSE MAZE

RELATED APPLICATION

This application is a continuation-in-part of provisional application Ser. No. 60/004,092, filed Sep. 21, 1995.

BACKGROUND OF THE INVENTION

1. Field of the Invention

The present invention relates generally to a miniature golf course and more particularly to a miniature golf putting course placed inside a maze and which is then varied by a series of gates to change the course.

2. Description of the Prior Art

One of the problems of running a miniature golf putting course is how to bring back repeat customers. Apparently, quite often, after a person has played a course a first time, the challenge is gone and they often do not return.

The conventional playing field for the game of golf is usually divided into eighteen holes, although quite often, only nine holes. The entire field of eighteen holes is normally broken down into two areas of nine holes each. The designing of a golf playing field is a highly skilled art, each area or group of holes, and each individual hole, being carefully designed to accommodate the golf play of various levels and grades of skill, from the better male golfer and top-skilled female golfer on down to the lesser skilled male and female players, as well as the younger golfers.

Each hole of a golf course comprises a tee area, a fairway, rough areas, and a green which includes a cup. The player pits his skill as an offense in moving the ball from the tee into the cup on the green in the least possible number of strokes, against a defense provided by the designer of the golf course, natural and pseudo-natural hazards. Natural hazards provided include such things as the use of hazards of terrain and topography, including undulations, contours, obstacles and obstructions, and including the use of trees, shrubs, bushes and other vegetation, and including the texture and height of grasses which effect the lie and roll of the ball.

Pseudo-natural hazards which can be built by the designer, include the making of contours and undulations to direct the play of the ball, the provision of sand traps, water holes, deliberately place vegetation, such as trees and shrubs, the placement of wind breaks, and the like.

The above principles also apply to the design of miniature golf courses and in addition, in the absence of size of a full sized golf course, designers must be more creative to provide a course that is challenging for all golfers but not intimidating or impossible to some.

In the absence of natural hazards, the defense against the golfer is carried into a miniature putting golf course by use of contours, undulations, plateaus, obstructions, curves, plateaus, rolls, swales and the like, all of which control the direction and amount of movement of the ball when it encounters and is played on the green area.

In view of the above complications involved in the designing and making of a golf course, it will be apparent that it is extremely difficult, if not impossible, to design a conventional golf course which has a single circuit or route that is taken by the golfers, in which the course is sufficiently difficult and interesting for the better golfers as well as the regular or fair golfers. It is even more difficult to provide a challenge for the golfer who has played a course more than once and is familiar with the layout and its appearance.

A first prior art golf course layout is shown in U.S. Pat. No. 3,156,470 to Newkirk which discloses a golf course embodying a plurality of different routes or circuits to be followed by the golfers, with one such route or circuit having substantially more difficult hazards than another such circuit. Each of the greens is provided with more than one fairway approach, where more than one route or circuit may be taken by the golfers to provide the same effect as a plurality of different golf courses, without requiring more than the normal number of greens of a single golf course. An additional green is placed on each fairway in order to accommodate the poorer and younger golfers so that each hole will be greatly shortened for such golfers, and so that these additional greens can be alternatively used by the regular golfers to reduce wear on the normal greens at the ends of the fairways.

U.S. Pat. No. 5,076,586 to Taniguchi et al discloses a miniature golf links which can afford golf players a feeling of golf play as experienced at a formal 9-hole golf links without using a large area for construction. Three courses are arrayed in a triangular configuration. In each one of two courses among the three courses are disposed one tee position for a long course, one tee position for a middle course, one tee for a short course and a putting green, and in the other one course are disposed three tee positions for middle courses and a putting green, making it possible to play golf of nine holes, par thirty six, by playing golf while going around the three courses either in the clockwise direction or in the counterclockwise direction.

Each of the references uses a different approach to change the alignment of the holes. Neither of the patents disclose a miniature golf course nor do they use swing gates to change the hole layout.

SUMMARY OF THE INVENTION

The invention is a miniature golf putting course designed in the form of a maze. This invention will allow the operator of the course to change the course layout at will. The miniature golf course is placed inside of a maze and is then controlled by a series of gates. Changing the position of the gates changes the route one must follow to correctly negotiate the course. This will inspire repeat play because the player will have to travel a different course layout each time they play.

DESCRIPTION OF THE PREFERRED EMBODIMENT

Figure 1:
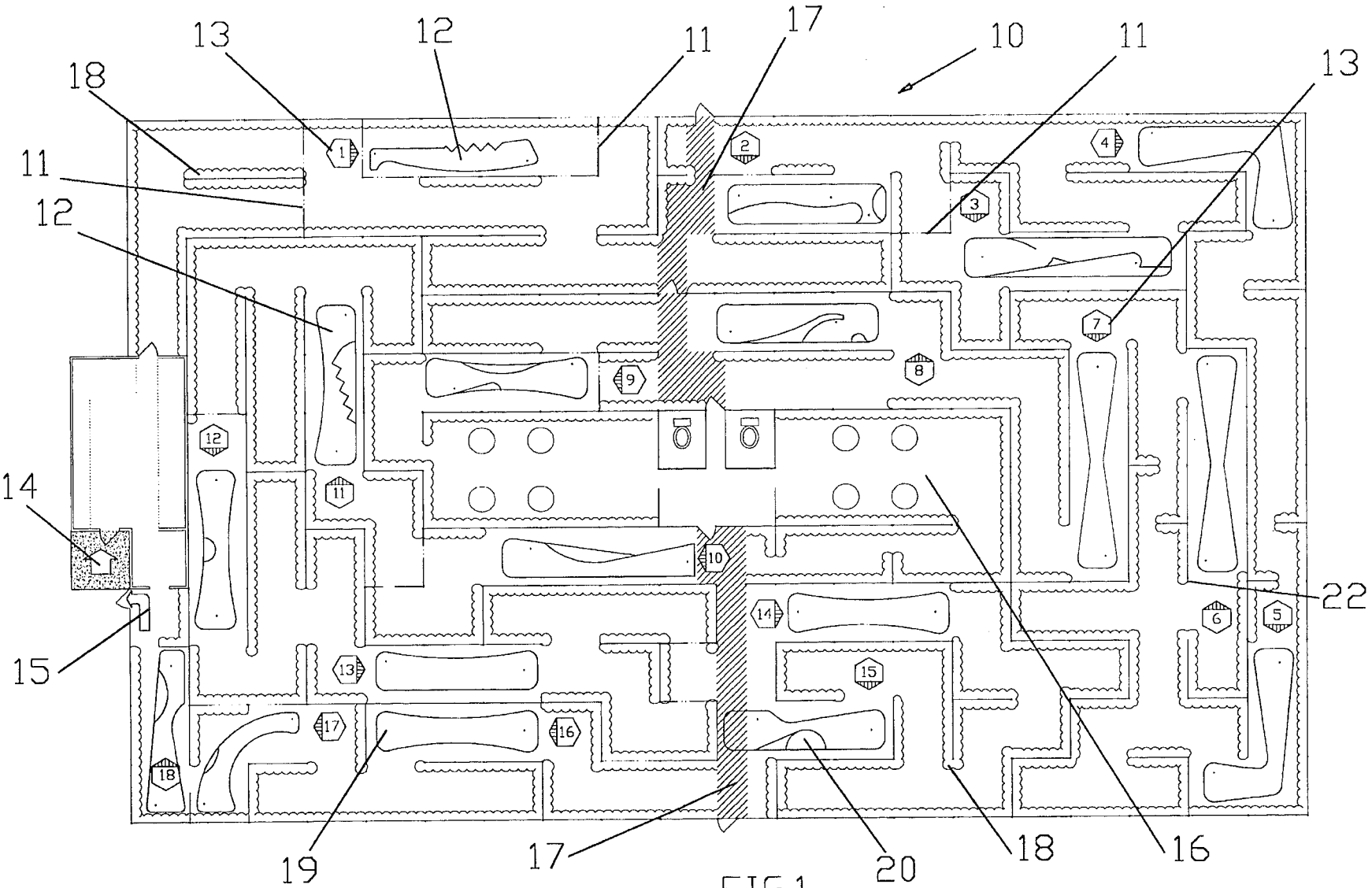
FIG. 1 is a schematic top plan view of a putting course in the form of a maze in accordance with the invention.

Referring to FIG. 1 there is a layout of a miniature golf putting course designed in the form of a maze as indicated by reference character 10. The reference character 11 indicates generally the gates in their various positions. The entire complex and the various paths of the maze 10 are enclosed by sections of fence grids 18 which may be made of any type of fence materials such as wire, shrubs, trees, planters, etcetera. The perimeter is surrounded with a permanent fence grid 18 which has only one entrance 14 and one exit 15. Two emergency exits 23 may also be provided. Although not a part of the invention, a building 24 may be provided to house an arcade. In the center of the maze 10, an area 16 is provided for vending machines and picnic tables.

Numeral 12 indicates the layout of each of the eighteen individual holes comprising the golf course, each of which has a different shape and comprises a different set of hazards. The tee ends 25 and the green ends 26 may be interchangeable to provide additional hole layouts. The cups 19 may be plugged at one end to provide a tee end 25 and unplugged to provide a cup (hole) 19 on green end 26 as desired. As can be seen by the different layouts of holes 12, reversing the play from one end to the other provides totally different playing routes and courses. For example, hazard 20 will be on different sides of the hole 12 when the tee end 25 is changed.

The holes 12 may be covered with any one of several suitable covers such as, for example, indoor-outdoor carpeting, Astro-turf or other durable outdoor covering suitable for simulating the effect of a golf ball rolling on grass. The hazards 20 may be raised, recessed or any other shape which will interfere with the path of the ball toward a hole and thus penalize a player by adding strokes when hit. Other types of structures such as miniature buildings, tunnels, bridges etcetera may also be used as hazards.

Figures 2, 3, 4, 5, 6, 7:
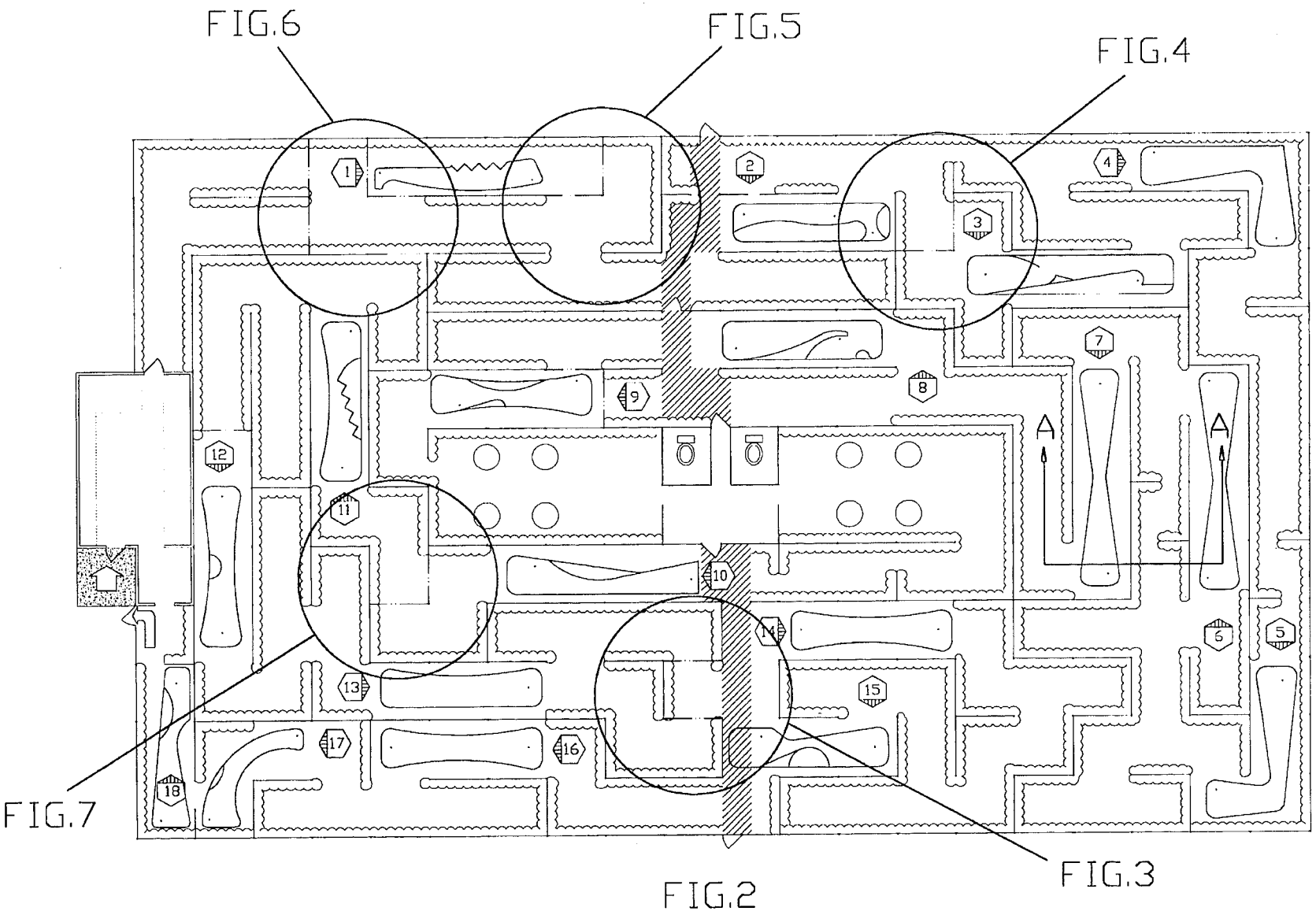
FIG. 2 is a schematic top plan view of a putting course in accordance with the invention having the gates highlighted by circles.
FIG. 3 is an expanded top plan view of alternate gate positions of the maze of the invention leading to hole number sixteen.
FIG. 4 is an expanded top plan view of first alternate gate positions of the maze of the invention leading to hole number three.
FIG. 5 is an expanded top plan view of first alternate gate positions of the maze invention leading to hole number one.
FIG. 6 is an expanded top plan view of first alternate gate positions of the maze invention leading to a second end of hole number one.
FIG. 7 is an expanded top plan view of first alternate gate positions of the maze invention leading to hole number eleven.
Figure 3B:
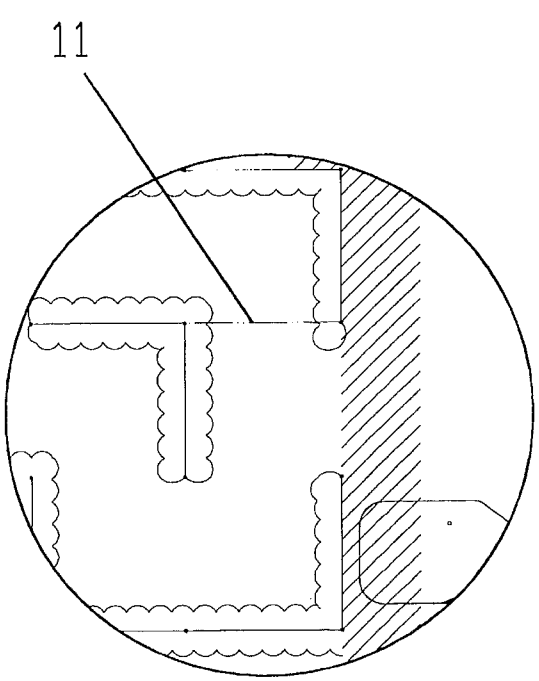
FIG. 3B is an expanded top plan view of a second gate position shown in FIG. 3.
Figure 3A:
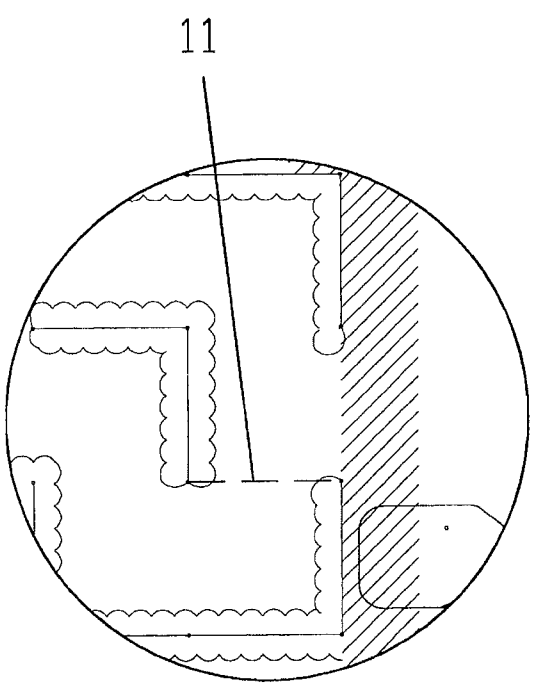
FIG. 3A is an expanded top plan view of a first gate position shown in FIG. 3.
Figure 3:
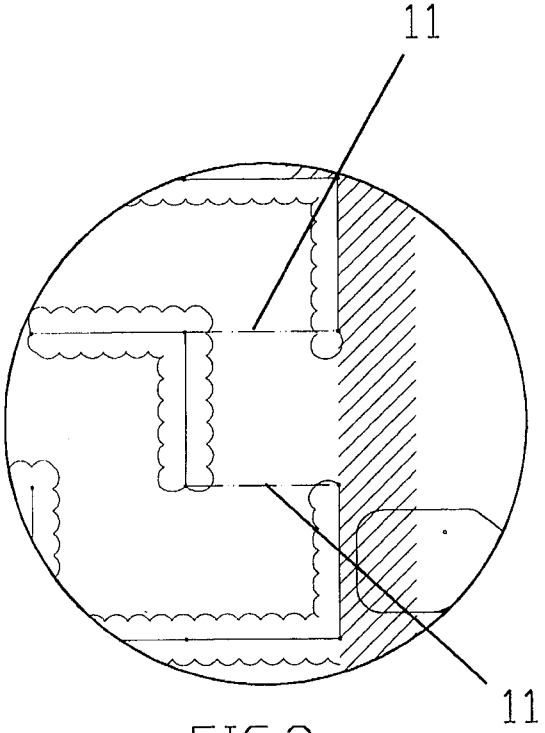
Figure 4A:
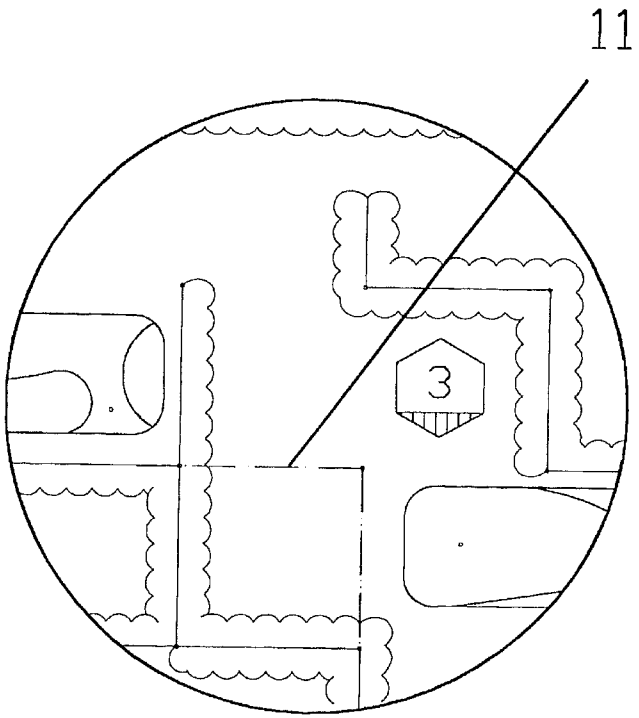
FIG. 4A is an expanded top plan view of second gate positions shown in FIG. 4.
Figure 4:
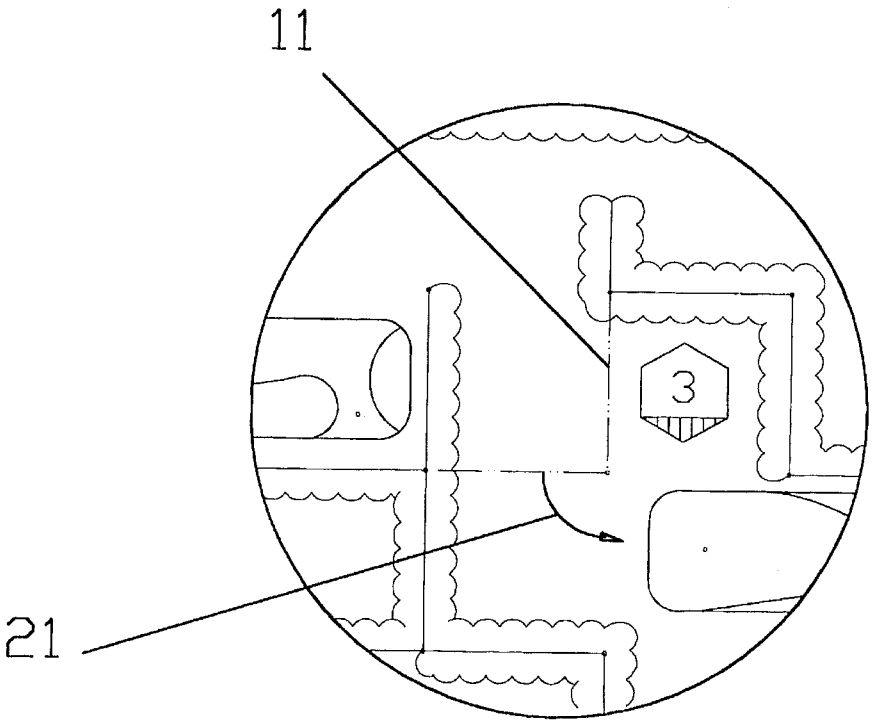

Referring now to FIGS. 3 through 7, there are shown the various positions of the gates 11 as the routes of the holes 12 are changed. FIG. 3 shows two gates 11 in their alternate positions and blocking the exit from hole #13 to hole #14. A player would then have to go to hole #16 which may be renumbered to #14 in a new configuration. With gate 11 in position as at FIG. 3A the player would have to exit hole #13 by turning left, then right, and then left to reach hole #14. In FIG. 3B, the player would have to turn right, then left, and then right again to reach hole #14. FIGS. 4 and 4A show two alternate routes from hole #2 to hole #3. Numeral 21 shows the direction of rotation of gate 11 to change the route.

FIG. 4 shows a gate 11 in a first position blocking an exit to the left. FIG. 4A shows a gate 11 in a second position blocking an exit to the right.

Figure 5A:
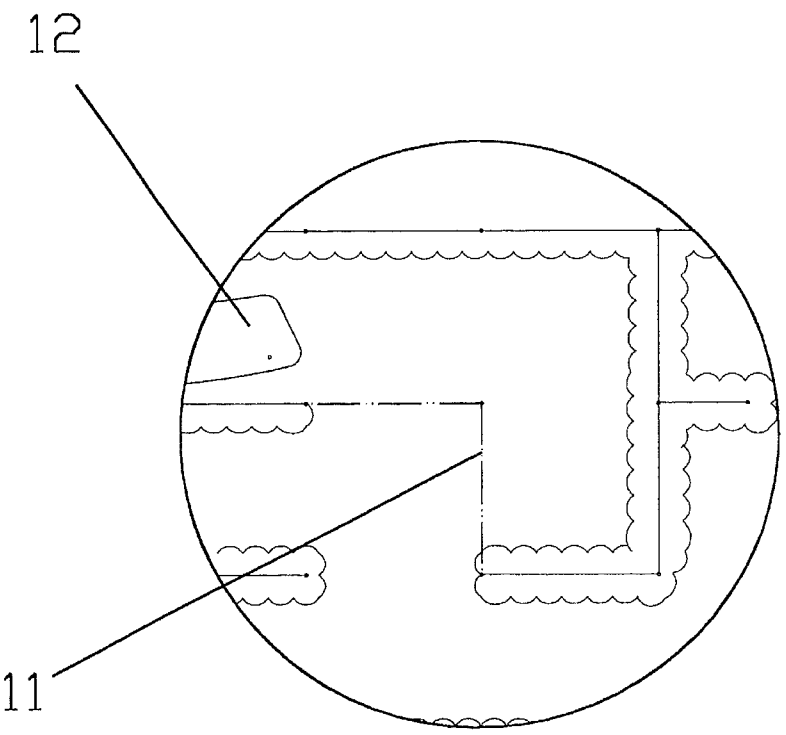
FIG. 5A is an expanded top plan view of second alternate gate positions of the maze invention leading to a first end of hole number one.
Figure 5:
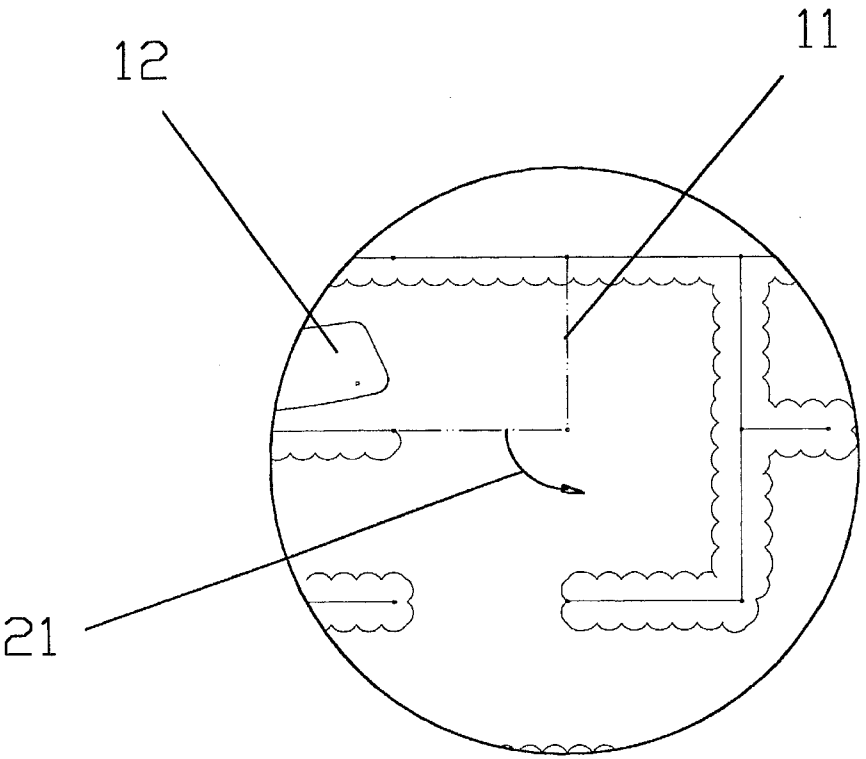

FIG. 5 shows two positions of gate 11 for changing the route between holes #1 and #2. FIG. 5 shows three possible positions of gate 11 controlling the exit from hole #1 and access to hole #2. FIG. 5A shows two additional alternate positions of gate 11.

Figure 6A:
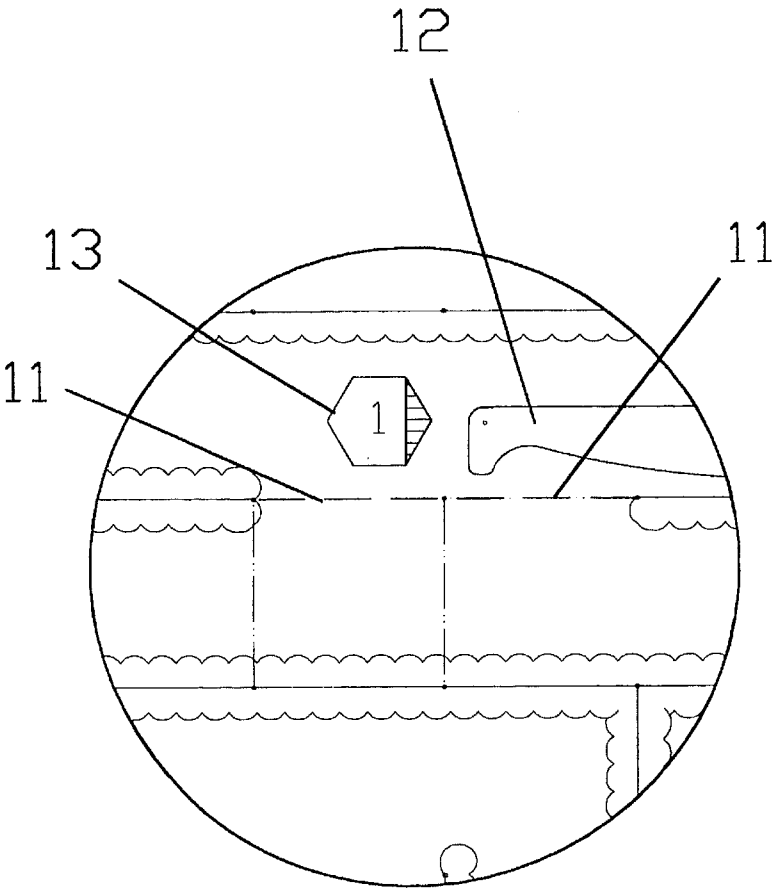
FIG. 6A is an expanded top plan view of second alternate gate positions of the maze invention leading to a second end of hole number one.
Figure 6:
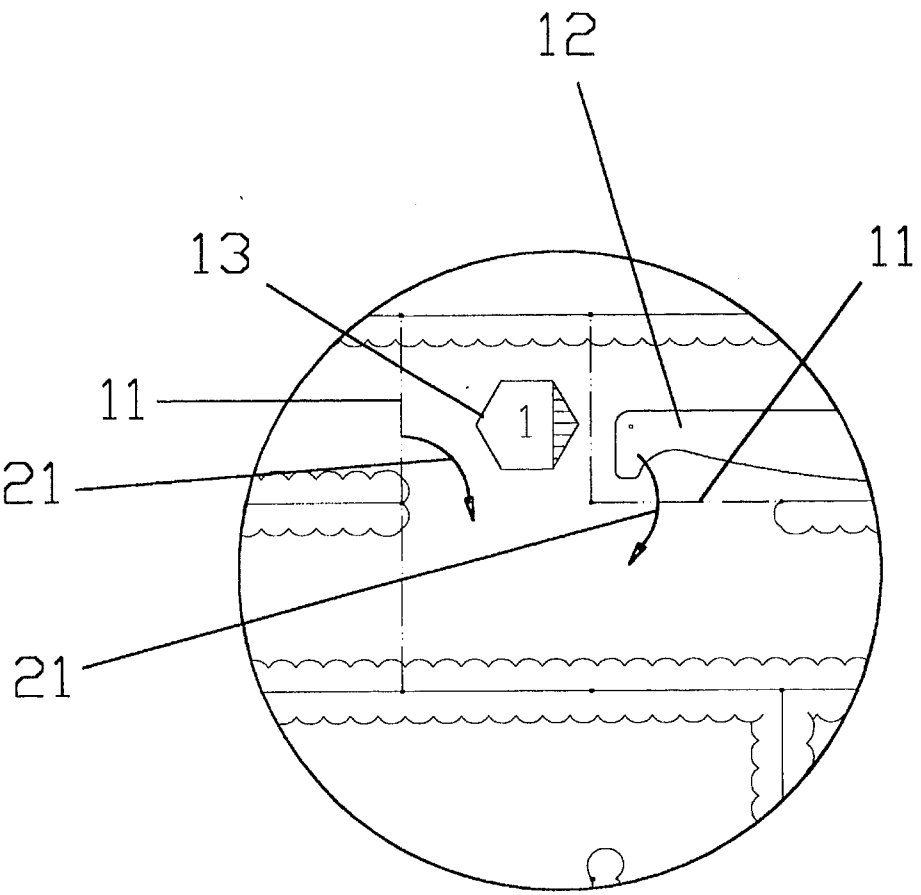

FIG. 6 shows several possible positions of gate 11 directing the entrance path to hole #1. FIG. 6A shows two alternate positions for gate 11 for directing the entrance path to hole #1 or in the alternative, the exit from hole #1 when the course is changed to a different configuration.

Figure 7A:
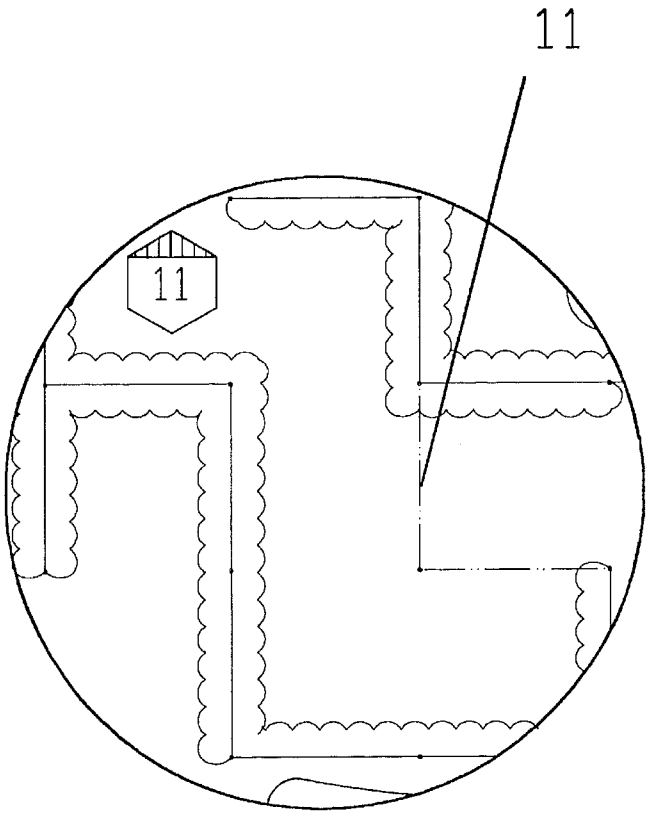
FIG. 7A is an expanded top plan view of second alternate gate positions of the maze invention leading to hole number eleven.
Figure 7:
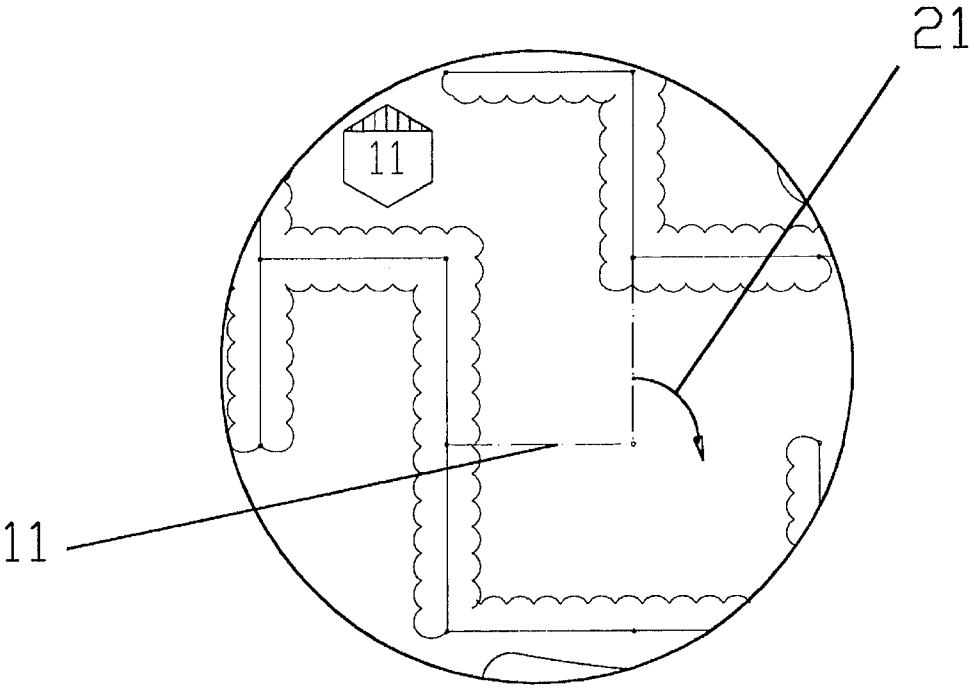

FIG. 7 shows several possible positions of gate 11 for directing the traffic flow between holes #10 and 11. FIG. 7A shows an alternate position of gate 11 changing the route of the path between holes #10 and #11.

Figure 8:
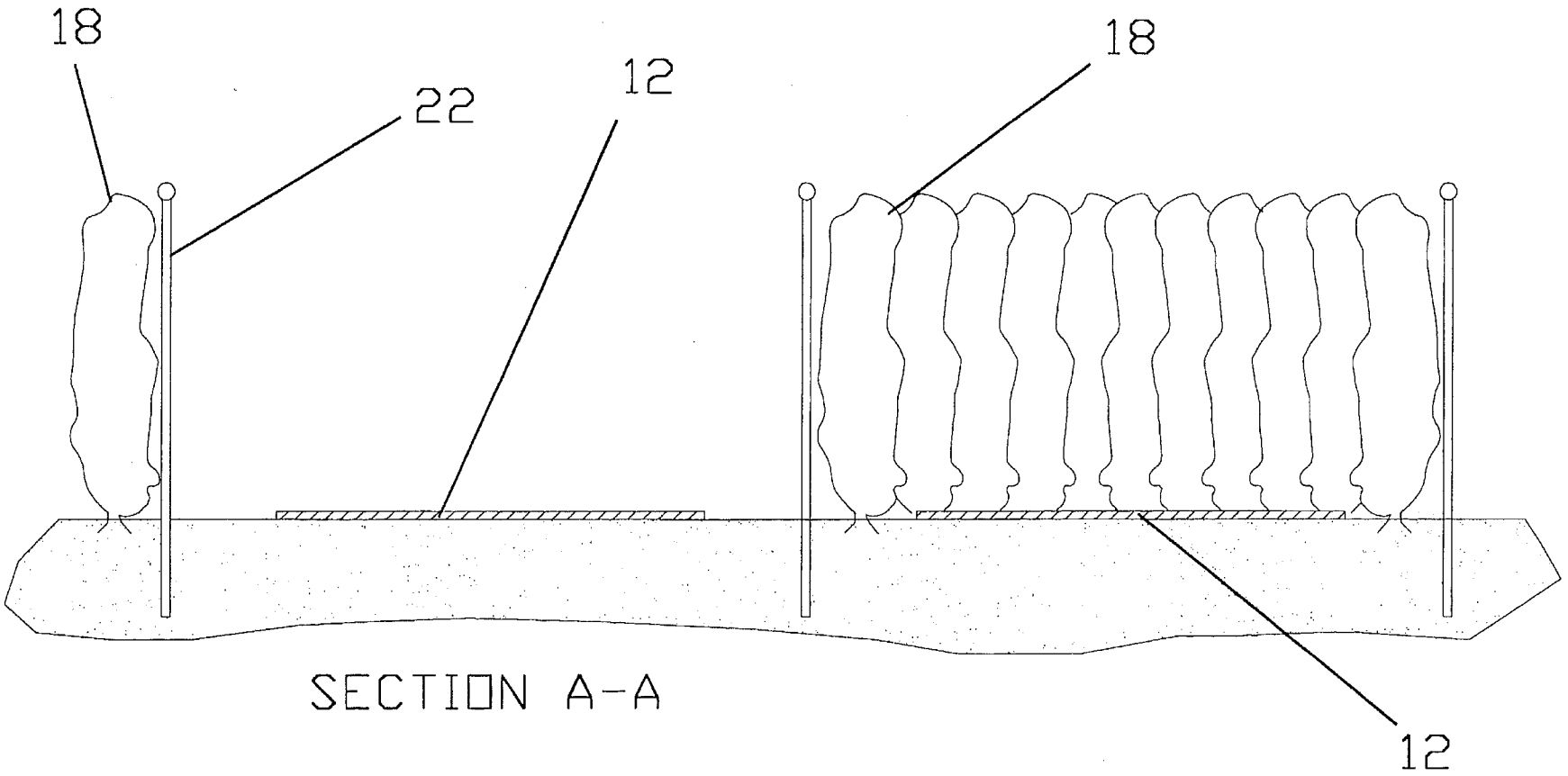
FIG. 8 is a side view, partially in section, taken along the lines A—A of FIG. 2.

FIG. 8 is a cross section taken along the line A—A of FIG. 2 showing the relationship between the putting holes 12, the fences 22, and the fence grids 18. The fences 22 and the fence grids 18 are designed to be sufficiently high to conceal the path of the maze from above and still low enough to provide for circulation of air. The fence grids 18, forming the gates 11, have sufficient foliage to form a visual barrier and sufficiently heavy to remain stationary in high winds which occur quite frequently in Florida. In addition, a certain amount of air circulation through the various fences would also be desirable. Likewise, a lighting installation for night play (not shown) is disposed along the outer and inner peripheries of the maze 10. As a result of the arrangement of a lighting installation for night play, the time of business can be extended, therefore the efficiency of management is enhanced.

While a principle of the present invention has been described above in connection to one preferred embodiment of the invention, it is intended that all matter contained in the above description and illustrated in the accompanying drawings shall be interpreted to be illustrative and not in a limiting sense.

What is claimed is:

1. A miniature golf course comprising:

a layout of an eighteen hole miniature golf putting course in the form of a maze, said maze having various paths enclosed by sections of fence grids, said various paths having a series of eighteen individual holes forming said putting course, each of said individual holes having a unique shape and a unique set of hazards, each of said holes having a tee end and a green end, each of said various paths being enclosed by said fence grids and separated from each other by said fence grids, and a plurality of gates located in selected positions at said tee ends and said green ends for alternately blocking said paths in a first position and directing the course of play in a different configuration in a second position.

2. The miniature golf course of claim 1, wherein each of said tee ends and said green ends contain a cup forming a golf hole, said cups being plugged or unplugged to form a green end or tee end as selected.

3. A miniature golf putting course comprising:

a layout of an eighteen hole golf putting course in the form of a maze, said maze having various gated paths enclosed by sections of fence grids, said various paths having a series of individual holes forming said putting course, each of said individual holes having a unique shape and a unique set of hazards, each of said holes having a cover suitable for simulating the effect of a golf ball rolling on grass, each of said hazards arranged to interfere with the path of a golf ball, each of said holes having a tee end and a green end, each of said paths being enclosed by said fence grids and separated from each other by said fence grids, each of said tee ends and said green ends having a cup forming a golf hole, said cups being plugged or unplugged to form a green end or a tee end as selected, and a plurality of gates located in selected positions at said tee ends and said green ends for alternately blocking said paths in a first position and directing the course of play in a different configuration in a second position.

* * * * *